US007809312B2

(12) United States Patent
Yoon et al.

(10) Patent No.: US 7,809,312 B2
(45) Date of Patent: Oct. 5, 2010

(54) TONER AGITATOR, TONER SUPPLYING APPARATUS INCLUDING THE SAME, AND METHOD OF SUPPLYING TONER

(75) Inventors: Hyung-won Yoon, Seoul (KR); Sam-seok Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 937 days.

(21) Appl. No.: 11/633,562

(22) Filed: Dec. 5, 2006

(65) Prior Publication Data

US 2008/0019738 A1 Jan. 24, 2008

(30) Foreign Application Priority Data

Jul. 20, 2006 (KR) ..... 10-2006-0068153

(51) Int. Cl.
*G03G 15/08* (2006.01)

(52) U.S. Cl. ..... 399/258; 399/262; 399/263

(58) Field of Classification Search ..... 399/258, 399/262, 263, 254
See application file for complete search history.

(56) References Cited

U.S. PATENT DOCUMENTS 5,206,692 A * 4/1993 Ishida et al. ..... 399/258
5,568,237 A * 10/1996 Ishida et al. ..... 399/263
5,870,652 A * 2/1999 Kanamori et al.
6,418,290 B1 7/2002 Isomura et al.
2005/0002699 A1 1/2005 Tamura et al.
2005/0041998 A1* 2/2005 Fujii et al. ..... 399/258

FOREIGN PATENT DOCUMENTS

| | | |
|---|---|---|
| EP | 1158370 | 11/2001 |
| JP | 11-338240 | 12/1999 |
| JP | 2006-017892 | 1/2006 |
| KR | 2005-65397 | 6/2005 |

OTHER PUBLICATIONS

Extended European Search Report dated Nov. 13, 2007 issued in EP 07108994.0.
Korean Office Action dated May 21, 2008 issued in KR 2006-68153.
European Search Report issued Jul. 9, 2009 in EP Application No. 09158861.6.

* cited by examiner

*Primary Examiner*—David M Gray
*Assistant Examiner*—Laura K Roth
(74) *Attorney, Agent, or Firm*—Stanzione & Kim, LLP

(57) ABSTRACT

A toner supplying apparatus includes a toner tank to hold toner, a supplying part that protrudes into the toner tank to discharge the toner from the toner tank, and a toner agitating member to rotate within the toner tank to agitate the toner in almost an entire inner space of the toner tank, including a location on a top surface of the supplying part that projects into the toner tank.

21 Claims, 6 Drawing Sheets

TONER AGITATOR, TONER SUPPLYING APPARATUS INCLUDING THE SAME, AND METHOD OF SUPPLYING TONER

CROSS-REFERENCE TO RELATED APPLICATIONS

This application claims priority under 35 U.S.C. §119(a) from Korean Patent Application No. 2006-0068153 filed Jul. 20, 2006, in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a toner supplying apparatus to supply an image forming apparatus with toner.

2. Description of the Related Art

Generally, some types of image forming apparatuses are supplied with toner for development by a separate toner supplying apparatus holding a predetermined amount of toner. When the separate toner supplying apparatus holding the predetermined amount of the toner is mounted to a predetermined position of the image forming apparatus, the toner is supplied to the image forming apparatus.

FIG. 1 is a view illustrating a conventional toner supplying apparatus used in an image forming apparatus.

Referring to FIG. 1, the toner supplying apparatus 1 includes a toner tank 10 and a supplying part 11. The supplying part 11 is formed in a substantially hollow cylindrical shape and projects inside the toner tank 10. A toner outlet 13 for discharging toner is provided at an outer surface of the supplying part 11. A toner-conveying device (not illustrated) that conveys toner in the toner tank 10 into the supplying part 11 is provided at a side of the supplying part 11. Also, a rotation shaft 15 is rotatably disposed at a center of the toner tank 10, and a toner agitating film 17 is fixed to the rotation shaft 15 to agitate the toner. At this time, the toner agitating film 17 has a width corresponding to an inner length L1 of the toner tank 10, exclusive of a width of the supplying part 11. Also, a driving gear 19 is disposed at an end of the rotation shaft 15 so that when the toner supplying apparatus 1 is mounted to the image forming apparatus (not illustrated), the rotation shaft 15 can be supplied with a rotation force by the image forming apparatus.

Therefore, when the toner supplying apparatus 1 is mounted to the image forming apparatus (not illustrated), the driving gear 19 rotates the rotation shaft 15 so that the toner agitating film 17 fixed to the rotation shaft 15 rotates. When the toner agitating film 17 rotates, the toner in the toner tank 10 is agitated to move downward to the toner-conveying device (not illustrated). Then, the toner-conveying device conveys the toner into the supplying part 11, so that the toner is discharged outside of the toner tank 10 through the toner outlet 13. A toner inlet 21 is provided under the toner outlet 13 and is in fluid communication with a developing unit 23 of the image forming apparatus. Therefore, the toner discharged through the toner outlet 13 falls into the toner inlet 21, is transported to the developing unit 23 of the image forming apparatus, and develops images.

However, the conventional toner supplying apparatus 1 with the above-described structure has a lot of toner left in the toner tank 10 when the toner of the toner supplying apparatus 1 is determined to have "run out" of toner, even though the toner agitating film 17 rotates to agitate the toner. This problem (i.e., a lot of toner left in the toner tank 10 when the toner of the toner supplying apparatus 1 is determined to have "run out" of toner) is caused by the structure of the toner supplying apparatus 1. In other words, because the toner supplying apparatus 1 has the supplying part 11 projecting inside the toner tank 10, the toner agitating film 17 cannot agitate the whole (entire) inner space of the toner tank 10, and as a result, some of the toner is left in the toner tank 10. In other words, the toner agitating film 17 agitates the toner in the inner space of the toner tank 10 except for a location on a surface of the supplying part 11 projecting inside the toner tank 10, so that the toner near the supplying part 11 cannot be moved to the outside thereof and instead remains inside the toner tank 10. If a lot of the toner remains in the toner tank 10, a toner using efficiency of the toner supplying apparatus 1 is decreased. As a result, a printing cost is increased. Also, discarding the toner remaining in the toner supplying apparatus 1 may cause environmental pollution.

SUMMARY OF THE INVENTION

The present general inventive concept provides a toner supplying apparatus to minimize an amount of toner remaining in a toner tank thereof when the toner tank should to be replaced.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a toner supplying apparatus, including a toner tank to hold toner, a supplying part projecting inside the toner tank to discharge the toner from the toner tank, and a toner agitating member rotatably disposed inside the toner tank to agitate the toner in almost an entire inner space of the toner tank including a location on a top surface of the supplying part projecting inside the tone tank.

The toner-agitating member may include a rotation shaft rotatably disposed at a center of the toner tank to rotate in a rotational direction, and a toner agitating film may include a first agitating part and a second agitating part to be separated from each other in the rotational direction of the rotation shaft.

The first agitating part may have a width corresponding to a width of the supplying part, and the second agitating part has a width corresponding to an inner length of the toner tank exclusive of the width of the supplying part.

Each of the first and second agitating parts may include at least one opening.

The first and second agitating parts may be formed from separate pieces of film.

The foregoing and/or other aspects and utilities of the present general inventive concept may also be achieved by providing a toner supplying apparatus, including a storage unit to store toner and having a projection projecting towards an interior of the storage unit, and an agitating unit to agitate the toner in the storage unit, the agitating unit comprising a first agitating part to contact an inner surface of the storage unit, and a second agitating part to contact a surface of the projection.

The agitating unit may further include a rotation shaft to rotate the first and second agitating parts in a rotation direction. The projection may be disposed on a bottom surface of the storage unit below the rotation shaft. The storage unit may have a substantially-cylindrical shape, and the rotation shaft may be disposed at a center of the storage unit.

Each of the first and second agitating parts may include a first end connected to the rotation shaft and a second end opposite to the first end, and the second ends of the first and second agitating parts may be separated from each other in a width direction parallel to an inner length of the storage unit by a predetermined separation gap. The first ends of the first and second agitating parts may be in contact with each other. The first ends of the first and second agitating parts may be separated from each other in the width direction by a second predetermined separation gap. Sizes of the predetermined separation gap and the second predetermined separation gap may be different from each other.

Lengths of the first and second agitating parts extending from the rotation shaft to the second ends of the first and second agitating parts may be substantially the same. The first agitating unit may have a width corresponding to a width of the projection, and the second agitating unit may have a width corresponding to the inner length of the storage unit exclusive of the width of the projection. The first and second agitating parts may have first and second widths, respectively, extending in a direction parallel to the inner length of the storage unit, and the second width may be wider than the first width.

The first and second agitating parts may be elastically-deformable independently of each other. At least one of the first and second agitating parts may include an opening to permit a passage of the toner therethrough. The first agitating part may include at least one first opening to permit a passage of the toner therethrough, and the second agitating part may include a plurality of second openings to permit a passage of the toner therethrough. The projection may be a supplying unit to supply toner from the interior of the storage unit to an exterior of the storage unit. The toner supplying apparatus may further include a conveying unit to convey the toner to the supplying unit. The agitating unit may have a width corresponding to an inner length of the storage unit. The toner supplying apparatus may have a toner using efficiency of at least 90%. The projection may include a plurality of projections, and the first agitating part may include a plurality of first agitating parts corresponding to the plurality of projections.

The foregoing and/or other aspects and utilities of the present general inventive concept may also be achieved by providing a film to agitate toner in a toner supply tank having an inwardly-projecting part, the film including a first agitating part that is elastically-deformable to agitate toner on a surface of the inwardly-projecting part, a second agitating part that is elastically-deformable to agitate toner on a surface of the toner supply tank, and a rotation shaft to rotate the first and second agitating parts, and each of the first and second agitating parts may include a first end connected to the rotation shaft and a second end opposite to the first end, and the second ends of the first and second agitating parts may be separated from each other in a width direction parallel to a length of the rotation shaft by a predetermined separation gap.

The foregoing and/or other aspects and utilities of the present general inventive concept may also be achieved by providing a method of agitating toner in a toner tank having a projection extending therein, the method including agitating toner on a surface of the projection by contacting an end of a first agitating part with the surface of the projection, and agitating toner on an inner surface of the toner tank by contacting an end of a second agitating part with the inner surface of the toner tank, and the ends of the first and second agitating parts may be separated from each other in a width direction parallel to an inner length of the toner tank by a predetermined separation gap.

The agitating of the toner on the surface of the projection may include elastically-deforming the first agitating part across the surface of the projection and separating the first agitating part from the second agitating part in a direction perpendicular to the inner length of the toner tank by a predetermined distance. The method may further include substantially-aligning the ends of the first and second agitating parts in the direction perpendicular to the inner length of the toner tank after the first agitating part contacts the surface of the projection.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
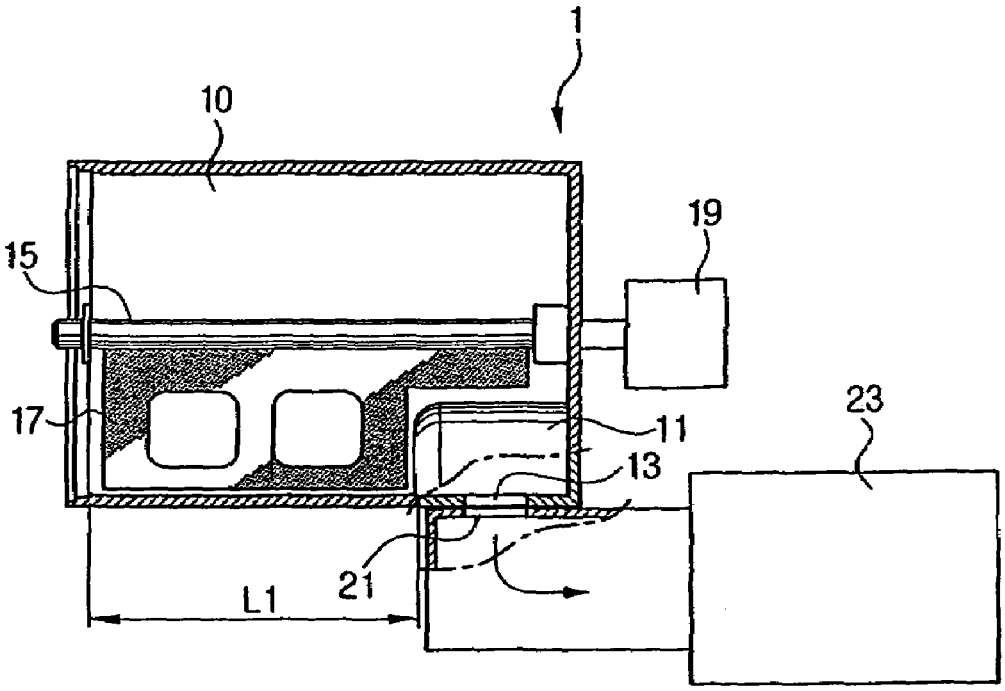
FIG. 1 (PRIOR ART)
FIG. 1 is a sectional view illustrating a conventional toner supplying apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
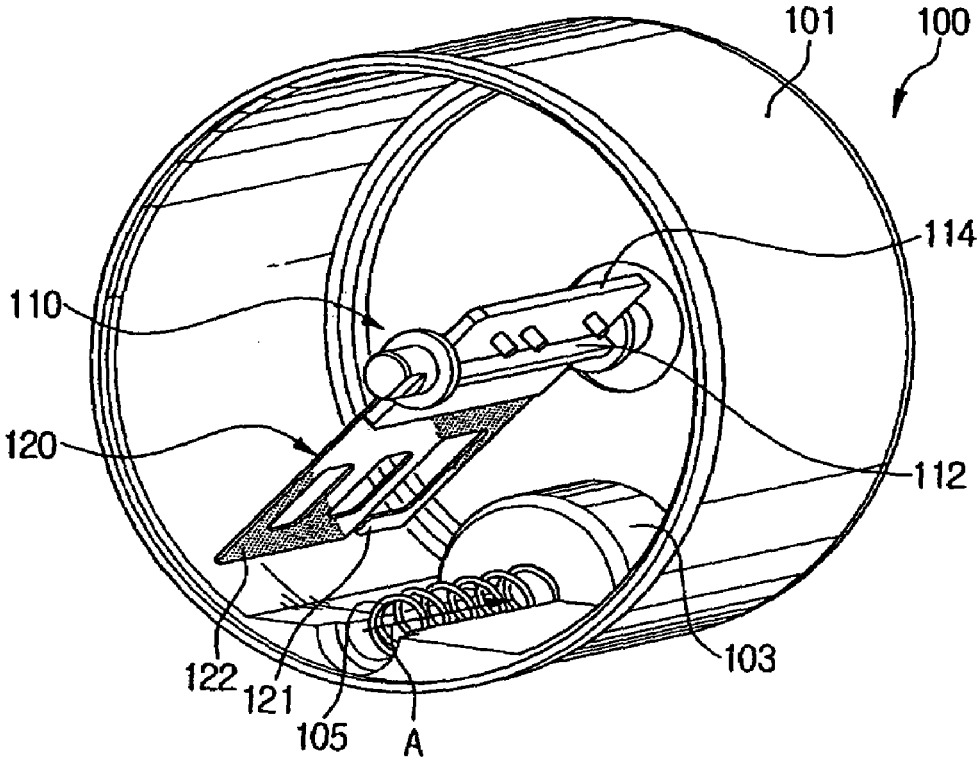
FIG. 2 is a perspective view illustrating a toner supplying apparatus, according to an embodiment of the present general inventive concept.

Referring to FIG. 2, a toner supplying apparatus 100 according to an embodiment of the present general inventive concept includes a toner tank 101, a supplying part 103, a toner-conveying member 105, and a toner-agitating member 110.

The toner tank 101 may store a predetermined amount of toner and may be formed in a substantially hollow cylindrical shape, as illustrated in FIG. 2. In FIG. 2, the toner tank 101 is illustrated as having an open back end so that an inside of the toner tank 101 can be illustrated. However, the actual toner tank 101 of the toner supplying apparatus 100 according to the present embodiment has a closed back end.

The supplying part 103 may be disposed at a bottom of the inside of the toner tank 101 and may discharge toner from the inside of the toner tank 101 to an outside of the toner tank 101. For example, the supplying part 103 may project from the bottom of the toner tank 101 to the inside of the toner tank 101 in a pillar shape with a semi-circular section. The supplying part 103 may include a toner outlet (not illustrated) to discharge the toner in an outer surface thereof.

The toner-conveying member 105 may be disposed at a side of the supplying part 103 at the bottom of the inside of the toner tank 101. The toner-conveying member 105 may be formed in, for example, a coil spring shape. An end of the toner-conveying member 105 may reach an inside the supplying part 103 so that when the toner-conveying member 105 rotates, the toner in the toner tank 101 is conveyed to the inside of the supplying part 103. The toner conveyed by the toner-conveying member 105 may be discharged to the outside through the toner outlet.

The toner-agitating member 110 may be rotatably disposed inside the toner tank 101 and forces the toner in the toner tank 101 to move in a downward direction (i.e., towards the bottom of the toner tank 101). For example, when the toner-agitating member 110 rotates at a middle of the toner tank 101, the toner in the toner tank 101 is agitated to prevent the toner from solidifying (i.e., from becoming solid). As a result, the toner moves down to the bottom of the toner tank 101 by its own weight.

The toner-agitating member 110 may include a rotation shaft 112 and a toner agitating film 120. The rotation shaft 112 may be rotatably disposed at a center of the toner tank 101 and may have a driving gear (not illustrated) coaxially coupled with an end of the rotation shaft 112 projecting from a side of the toner tank 101. Therefore, the rotation of the driving gear causes the rotation shaft 112 to rotate. Also, the rotation shaft 112 may have a wing plate 114 to help fix the toner agitating film 120 to the rotation shaft 112. The wing plate 114 may be formed to be substantially symmetric with respect to the rotation shaft 112.

Figure 3:
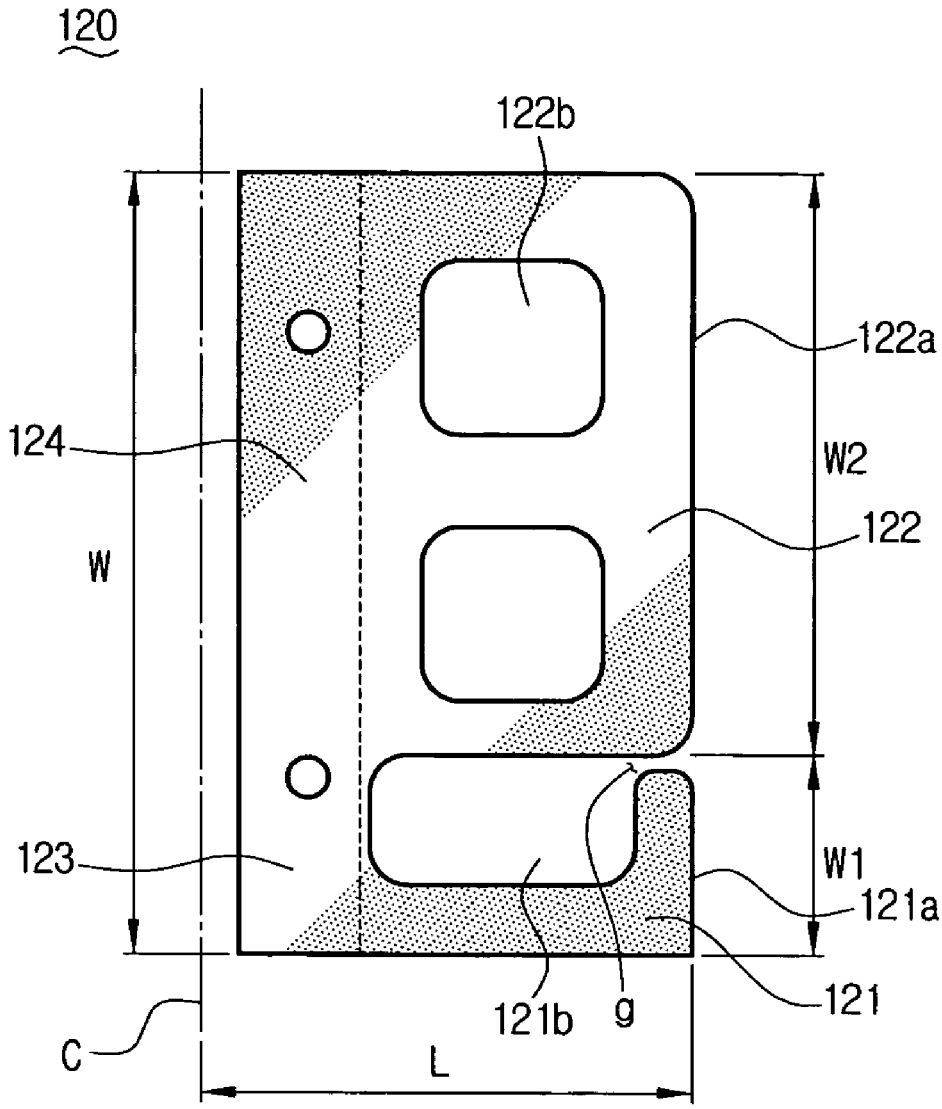
FIG. 3 is a plan view illustrating a toner agitating film of the toner supplying apparatus of FIG. 2, according to an embodiment of the present general inventive concept.

Referring to FIG. 3, the toner agitating film 120 may have a width W corresponding to the inner length of the toner tank 101. Furthermore, the toner agitating film 120 may be elastically-deformable. For example, the toner agitating film 120 may bend along a projection projecting inside the toner tank 101, such as the supplying part 103, when the toner agitating film contacts the projection. Also, the toner agitating film 120 may have a length L from a center axis C of the rotation shaft 112 to ends 121*a* and 122*a* of the toner agitating film 120, and the length L may correspond to an inner radius of the toner tank 101. For example, the toner agitating film 120 may be formed so that the ends 121*a* and 122*a* of the toner agitating film 120 touch an inner surface 101*a* (see FIG. 4) of the toner tank 101. Alternatively, the toner agitating film 120 may be formed to have a narrow gap between the ends 121*a* and 122*a* of the toner agitating film 120 and the inner surface 101*a* of the toner tank 101.

As illustrated in FIGS. 2 and 3, the toner agitating film 120 may have a first agitating part 121 and a second agitating part 122. The first and second agitating parts 121 and 122 may include a separation gap g separating the ends 121*a* and 122*a* from each other by a predetermined distance, as illustrated in FIG. 3. In other words, the first and second agitating parts 121 and 122 are formed so that the end 121*a* of the first agitating part 121 and the end 122*a* of the second agitating part 122 are separated from each other in a rotational direction of the toner agitating film 120 by the separation gap g. As illustrated in FIG. 3, the above-described toner agitating film 120 may have the first and second agitating parts 121 and 122 formed in one piece (i.e., formed from a single piece of film). In other words, the although ends 121*a* and 122*a* of the first and second agitating parts 121 and 122, respectively, may be separated from each other, opposite ends 123 and 124 of the first and second agitating parts 121 and 122, respectively, may be in contact with (e.g., connected to) each other.

Figure 4:
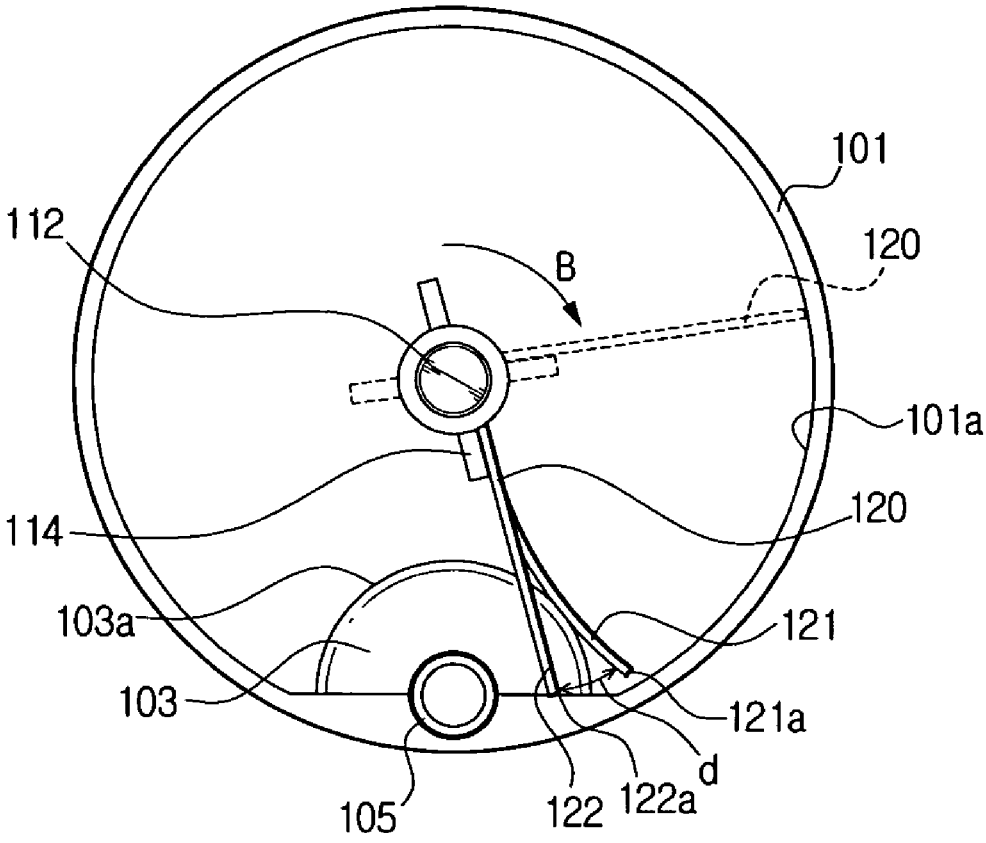
FIG. 4 is a sectional view illustrating an operation of a toner agitating film of the toner supplying apparatus of FIG. 2, according to an embodiment of the present general inventive concept.

The first agitating part 121 may have a width W1 corresponding to the width of the supplying part 103, and the second agitating part 122 may have a width W2 corresponding to the inner length of the toner tank 101 exclusive of the width of the supplying part 103. Therefore, when the first agitating part 121 moves up along a top surface 103a of the supplying part 103 by the rotation of the rotation shaft 112, the second agitating part 122 can move along the inner surface 101*a* of the toner tank 101 unimpeded by the movement of the first agitating part 121 with respect to the supplying part 103. In other words, the toner agitating film 120 may rotate integrally with the rotation shaft 112 with the first agitating part's end 121*a* and the second agitating part's end 122*a* separated from each other by a predetermined distance d when the first agitating part 121 moves along the surface 103*a* of the supplying part 103, as illustrated in FIG. 4.

Furthermore, the toner agitating film 120 may have at least one opening, such as one or both of openings 121*b* and 122*b*. For example, the first agitating part 121 and the second agitating part 122 may each have at least one opening, such as the openings 121*b* and 122*b*, respectively. The openings 121*b* and 122*b* may help the toner agitating film 120 to agitate the toner, and/or may decrease the rotation force that rotates the toner agitating film 120. In this embodiment, the first agitating part 121 has one opening 121*b*, and the second agitating part 122 has two openings 122*b*. However, the present general inventive concept is not limited to this arrangement of openings.

Figure 5:
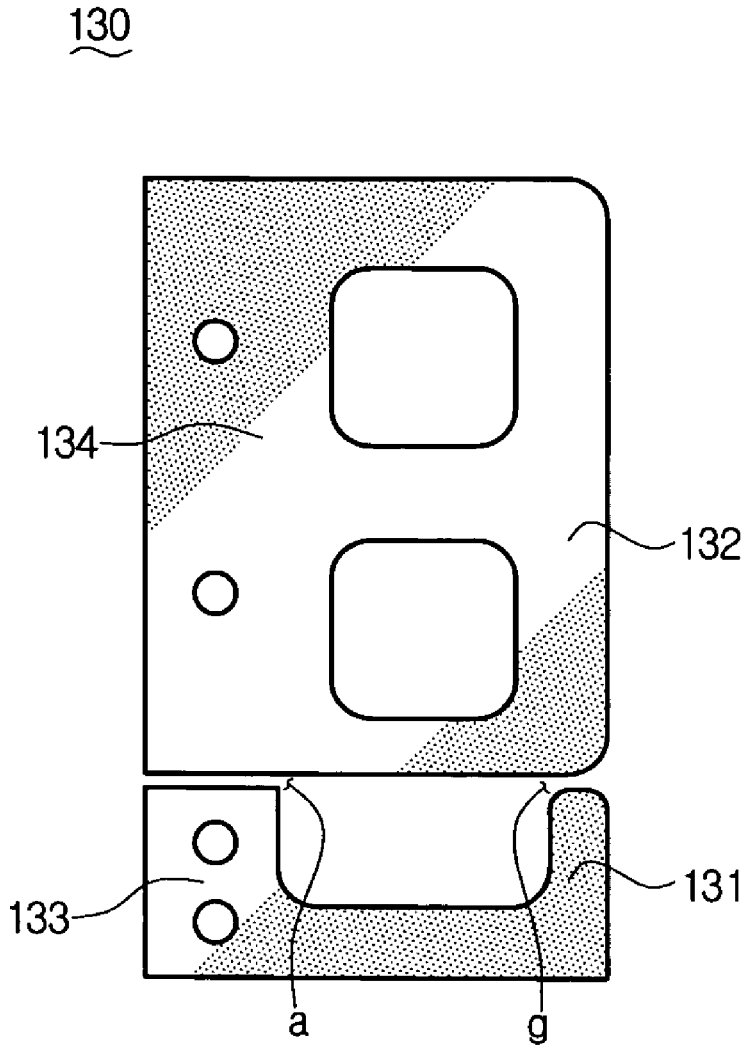
FIG. 5 is a plan view illustrating another toner agitating film of the toner supplying apparatus of FIG. 2, according to another embodiment of the present general inventive concept.

FIG. 5 is a view illustrating a toner agitating film 130 as another example of a toner agitating film of the toner supplying apparatus 100 of FIG. 2, according to another embodiment of the present general inventive concept. The toner agitating film 130 according to this embodiment has a first agitating part 131 and a second agitating part 132 that are separately formed (i.e., formed by separate pieces of film), and fixed to the rotation shaft 112, in contrast to the above-described toner agitating film 120 of FIG. 3, which has the first and second agitating parts 121 and 122 formed in one piece (i.e., formed by a single piece of film). Thus, opposite ends 133 and 134 of the first and second agitating parts 131 and 132, respectively, may be separated from each other by a second predetermined separation gap a. The separation gap g and the second separation gap a may be the same size, or may be different sizes. Except for being formed by separate pieces of film, the remaining structure and operation of the toner agitating film 130 of the present embodiment can be substantially the same as the structure and operation of the toner agitating film 120 of the previous embodiment, so that detailed descriptions thereof are omitted.

In the above description, the toner agitating film 120 (or 130) has the structure corresponding to the toner tank 101 having only one projection (e.g., the part projecting 103) projecting inside the toner tank 101; however, this should not be considered as limiting the present general inventive concept. For example, when the toner tank 101 has two or more projections projecting inside the toner tank 101, the toner agitating film 120 (or 130) may include a number of agitating parts corresponding to the number of the two or more projections in the width direction thereof. Therefore, the toner agitating film 120 (or 130) can agitate the toner located almost anywhere in the toner tank 101.

Figure 6:
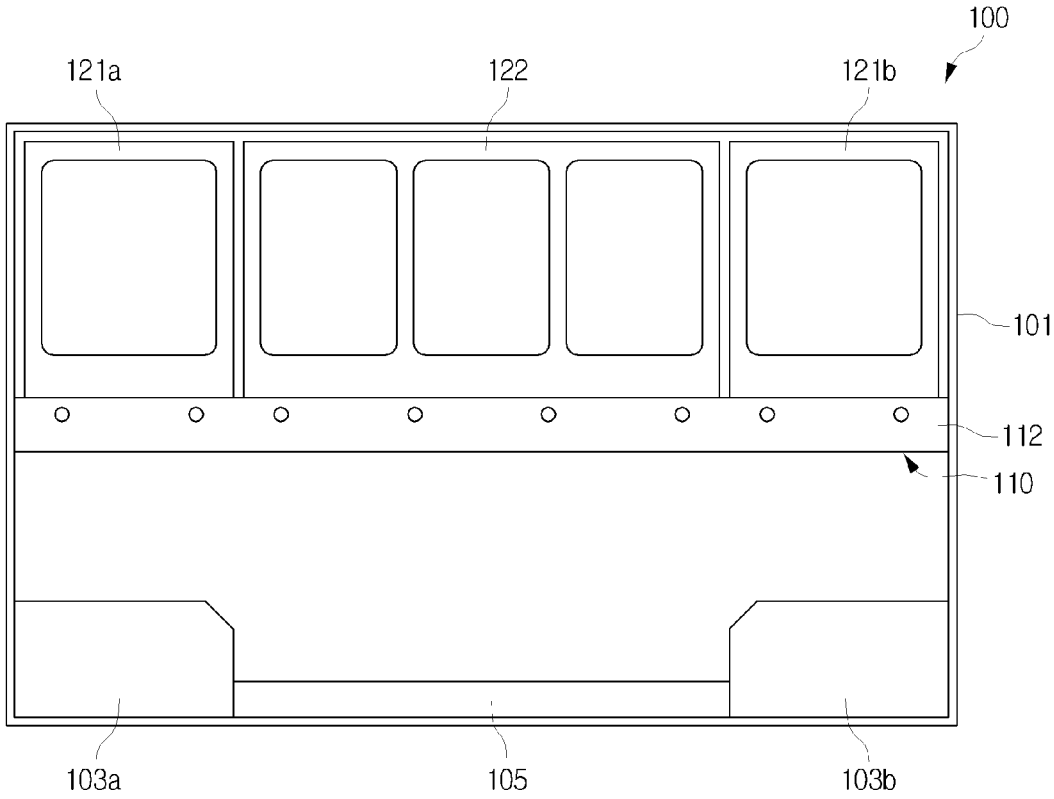
FIG. 6 illustrates a toner tank having multiple protruding parts.

For example, as illustrated in FIG. 6, a toner supplying apparatus 100 may include a toner tank 101 to store toner. The tank 101 may include two supplying parts 103*a* and 103*b*. The toner agitating member 110 may include multiple agitating parts to correspond to the supplying parts 103*a* and 103*b*. In this case, the toner agitating member 110 may include two first agitating parts 121*a* and 121*b* to correspond to the two supplying parts 103*a* and 103*b*, respectively.

Hereinafter, an operation of the toner supplying apparatus 100 of FIG, 2, according to an embodiment of the present general inventive concept, will be explained with reference to FIGS. 2 to 4.

When the toner supplying apparatus 100 is mounted to an image forming apparatus (not illustrated), a driving gear (not illustrated) of the toner supplying apparatus 100 receives a rotation force from the image forming apparatus and rotates. The rotation of the driving gear causes the rotation shaft 112 to rotate so that the toner agitating film 120 fixed to the wing plate 114 of the rotation shaft 112 (or the toner agitating film 120 fixed to the rotation shaft 112 in another way, such as directly thereto, in the absence of the wing plate 114) rotates integrally with the rotation shaft 112.

When the toner agitating film 120 rotates inside the toner tank 101, the first agitating part 121 of the toner agitating film 120 touches the top surface 103*a* of the supplying part 103 at a predetermined location. The rotation shaft 112 continues to rotate while the first agitating part 121 is in contact with the top surface 103*a* of the supplying part 103 at the predetermined location, and the first agitating part 121 is bent in a reverse direction of the rotational direction of the rotation shaft 112 (i.e., the first agitating part 121 is bent in a reverse direction of the direction of arrow B in FIG. 4) and slides on the top surface 103*a* of the supplying part 103 as illustrated in FIG. 4. At this time, the second agitating part 122 remains substantially straight (e.g., is not bent in the reverse direction to the extent that the first agitating part 121 is bent) when it rotates integrally with the rotation shaft 112. In other words, the toner agitating film 120 may rotate with the end 121*a* of the first agitating part 121 and the end 122*a* of the second agitating part 122 being apart from each other in the rotational direction thereof by the predetermined distance d, as illustrated in FIG. 4.

Therefore, the first agitating part 121 can agitate the toner that is piled up near the supplying part 103, e.g., on the top surface 103*a* of the supplying part 103, to fall to the bottom of the toner tank 101 where the toner-conveying member 105 is disposed. In other words, the first agitating part 121 agitates the toner disposed on the top surface 103*a* of the supplying part 103 to fall to the toner-conveying member 105. After the first agitating part 121 leaves the top surface 103*a* of the supplying part 103 due to the continued rotation of the rotation shaft 112, the toner agitating film 120 rotates with the end 121*a* of the first agitating part 121 and the end 122*a* of the second agitating part 122 being substantially in a straight line. That is, after the first agitating part 121 bends in the reverse direction opposite to the rotation direction of the toner agitating film 120 to contact the top surface 103*a*, the first agitating part 121 returns to an original position (i.e., a position before the bending thereof), which allows the ends 121*a* and 122*a* to substantially align with each other, thus substantially eliminating the distance d between the first and second agitating parts 121 and 122.

When the toner agitating member 110 rotates, the first and second agitating parts 121 and 122 agitate toner in almost the entire inner space of the toner tank 101 to move the toner to the bottom of the toner tank 101. At this time, the toner-conveying member 105 receives a rotation force from a driving source (not illustrated) and rotates to convey the toner at the bottom of the toner tank 101 in a direction A into the supplying part 103, as illustrated in FIG. 2. The toner conveyed into the supplying part 103 is discharged outside of the toner tank 101 through a toner outlet (not illustrated). The discharged toner may be supplied to a developing unit of the image forming apparatus to develop images.

Toner using efficiencies were measured for four toners having different colors using a conventional toner supplying apparatus including a toner tank, and using a toner supplying apparatus according to an embodiment of the present general inventive concept, including a toner tank and a toner-agitating member having two agitating parts formed using a single piece of film. The results are summarized in Table 1. Here, the "toner using efficiency" refers to a percentage of toner stored in the toner tank that is used to print images before the toner supply apparatus should be replaced. Thus, a higher toner using efficiency indicates a lower amount of toner remaining in the toner supply apparatus upon replacement thereof. Accordingly, a higher toner using efficiency is desired.

TABLE 1

| Toner color | Conventional toner supplying apparatus (%) | Toner supplying apparatus according to the present embodiment(%) | Difference (%) |
|---|---|---|---|
| Yellow | 84.75 | 94.25 | 9.5 |
| Magenta | 83.75 | 94.25 | 10.5 |
| Cyan | 84.25 | 94.75 | 10.5 |
| Black | 88.15 | 96.78 | 8.63 |

The results summarized in Table 1 demonstrate that the toner using efficiency of the toner supplying apparatus according to the present embodiment is higher than the toner using efficiency of the conventional toner supplying apparatus. Therefore, the amount of toner remaining in the toner supplying apparatus according to the present embodiment is less than the amount of toner remaining in the conventional toner supplying apparatus. For example, the toner using efficiency of the toner supplying apparatus according to the present embodiment may be about 8% to about 11% higher than the corresponding toner using efficiency of the conventional supplying apparatus.

With a toner supplying apparatus according to embodiments of the present general inventive concept, because toner on projections projecting inside a toner tank of the toner supplying apparatus can be agitated, almost all of the toner in the toner tank can be used. Therefore, when the toner supplying apparatus is replaced, an amount of toner remaining in the toner tank is minimized.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner supplying apparatus, comprising:

a storage unit to store toner and having a supplying part projecting towards an interior of the storage unit to discharge toner from the storage unit; and an agitating unit to agitate the toner in the storage unit, the agitating unit comprising an agitating film having a first agitating part and a second agitating part, wherein an outer end of the first agitating part is configured to contact an inner surface of the storage unit and a surface of the supplying part and an outer end of the second agitating part is configured to contact the inner surface of the storage unit;

wherein the first and second agitating parts extend side-by-side on the same radial plane away from a rotation shaft of the agitating unit to respective outer ends, whereby at least the outer ends of the first and second agitating parts are separated from each other in a width direction parallel to the rotation shaft by a predetermined separation gap, and the first agitating part is configured to bend to slide on the surface of the supplying part during rotation of the agitation film relative to the storage unit, such that the first and second agitating parts are spaced apart from each other in a direction of rotation during rotation of the agitation film relative to the storage unit.

2. The toner supplying apparatus of claim 1, wherein the first and second agitating parts are formed from separate pieces of film.

3. The toner supplying apparatus of claim 1, wherein the rotation shaft rotates the first and second agitating parts in a rotation direction.

4. The toner supplying apparatus of claim 3, wherein the supplying part is located on a bottom surface of the storage unit below the rotation shaft.

5. The toner supplying apparatus of claim 3, wherein the storage unit has a substantially-cylindrical shape, and the rotation shaft is located at a center of the storage unit.

6. The toner supplying apparatus of claim 3, wherein:

each of the first and second agitating parts includes a first end connected to the rotation shaft and a second end the second end corresponding to the outer ends, opposite to the first end; and the second ends of the first and second agitating parts are separated from each other in the width direction parallel to an inner length of the storage unit by the predetermined separation gap.

7. The toner supplying apparatus of claim 6, wherein the first ends of the first and second agitating parts are in contact with each other.

8. The toner supplying apparatus of claim 6, wherein the first ends of the first and second agitating parts are separated from each other in the width direction by a second predetermined separation gap.

9. The toner supplying apparatus of claim 8, wherein sizes of the predetermined separation gap and the second predetermined separation gap are different from each other.

10. The toner supplying apparatus of claim 6, wherein lengths of the first and second agitating parts extending from the rotation shaft to the second ends of the first and second agitating parts are substantially the same.

11. The toner supplying apparatus of claim 6, wherein the first agitating part has a width corresponding to a width of the supplying part, and the second agitating part has a width corresponding to the inner length of the storage unit excluding the width of the projection.

12. The toner supplying apparatus of claim 6, wherein the first and second agitating parts have first and second widths, respectively, extending in a direction parallel to the inner length of the storage unit, and the second width is wider than the first width.

13. The toner supplying apparatus of claim 1, wherein the first and second agitating parts are elastically-deformable independent of each other.

14. The toner supplying apparatus of claim 1, wherein at least one of the first and second agitating parts comprises an opening to permit a passage of the toner therethrough.

15. The toner supplying apparatus of claim 1, wherein the first agitating part comprises at least one first opening to permit a passage of the toner therethrough, and the second agitating part comprises a plurality of second openings to permit a passage of the toner therethrough.

16. The toner supplying apparatus of claim 1, wherein the supplying unit supplies toner from the interior of the storage unit to an exterior of the storage unit.

17. The toner supplying apparatus of claim 16, further comprising a conveying unit to convey the toner to the supplying unit.

18. The toner supplying apparatus of claim 1, wherein the agitating unit has a width corresponding to an inner length of the storage unit.

19. The toner supplying apparatus of claim 1, wherein:

the supplying part comprises a plurality of projections; and the first agitating part comprises a plurality of first agitating parts corresponding to the plurality of projections.

20. A method of agitating toner in a toner supplying apparatus having a supplying part extending therein, the method comprising:

agitating toner on an inner surface of a toner tank and a surface of the supplying part by contacting an outer end of a first agitating part with the inner surface of the toner tank and with the surface of the supplying part; and agitating toner on an inner surface of the toner tank by contacting an outer end of a second agitating part with the inner surface of the toner tank, wherein the first and second agitating parts extend side-by-side on the same radial plane away from a rotation shaft of the agitating unit to the respective outer ends whereby the outer ends of the first and second agitating parts are separated from each other in a width direction parallel to the rotation shaft by a predetermined separation gap, and the agitating of the toner on the surface of the supplying part comprises rotating the agitating film relative to the toner tank, wherein the first agitating part bends to slide on the surface of the supplying part, such that the first and second agitating parts are separated in a direction perpendicular to the inner length of the toner tank by a predetermined distance when the outer end of the first agitating part contacts the surface of the supplying part.

21. The method of claim 20, further comprising substantially aligning the outer ends of the first and second agitating parts in a direction perpendicular to the inner length of the toner tank when the first agitating part does not contact the surface of the supplying part.

* * * * *